US009771193B2

(12) United States Patent
Banning et al.

(10) Patent No.: US 9,771,193 B2
(45) Date of Patent: Sep. 26, 2017

(54) ARTICULATING LID FOR BEVERAGE CONTAINER

(71) Applicant: BUNN-O-MATIC CORPORATION, Springfield, IL (US)

(72) Inventors: Jason M. Banning, Springfield, IL (US); Evan Sharp, Springfield, IL (US); Jamie Ratterman, Springfield, IL (US)

(73) Assignee: Bunn-O-Matic Corporation, Springfield, IL (US)

( * ) Notice: Subject to any disclaimer, the term of this patent is extended or adjusted under 35 U.S.C. 154(b) by 0 days.

(21) Appl. No.: 14/693,349

(22) Filed: Apr. 22, 2015

(65) Prior Publication Data

US 2016/0311583 A1 Oct. 27, 2016

(51) Int. Cl.
*B65D 43/14* (2006.01)
*B65D 51/24* (2006.01)
*B65D 43/20* (2006.01)

(52) U.S. Cl.
CPC ..... *B65D 51/245* (2013.01); *B65D 43/20* (2013.01)

(58) Field of Classification Search
CPC ..... A47J 31/42; A47J 31/40; B65D 43/12; B65D 43/20
USPC ..... 220/811–816
See application file for complete search history.

(56) References Cited

U.S. PATENT DOCUMENTS 2,107,997 A * 2/1938 Horsley ..... A45C 13/16 160/231.1
2,133,651 A * 10/1938 Baker ..... B65D 43/20 206/536
4,230,381 A 10/1980 Rhoades
5,042,731 A * 8/1991 Ford ..... A47J 42/40 193/32
5,199,597 A 4/1993 Gladish
5,242,093 A 9/1993 Worrell et al.
5,305,924 A 4/1994 Groover et al.
6,129,237 A * 10/2000 Miyahara ..... B65D 43/165 220/255
7,152,765 B1 12/2006 Midden et al.
7,222,759 B2 5/2007 Bunn et al.
7,275,653 B2 10/2007 Tedford, Jr.
7,589,843 B2 * 9/2009 Aiyer ..... G01B 11/0675 356/485
8,348,081 B2 * 1/2013 Baptiste ..... B65F 1/1468 220/345.1

(Continued)

FOREIGN PATENT DOCUMENTS

WO WO 2013/127906 9/2013

*Primary Examiner* — Shawn M Braden

(74) *Attorney, Agent, or Firm* — Barnes & Thornburg LLP

(57) ABSTRACT

Disclosed is a lid for a beverage container configured to retain a beverage from a brewer or other source of beverage. The lid is configured to substantially cover or enclose an opening of the beverage container for receiving a beverage into a vessel of the container. The lid further includes a base and a door, the door being slidable with respect to the base from a first closed position that prevents access to the opening to a second opened position that permits access to the opening. The door further including a first and second panel that are connected together each other along a pivot axis. The second panel is pivotable with respect to the first panel when the door is slid from the first closed position.

8 Claims, 8 Drawing Sheets

(56) References Cited

U.S. PATENT DOCUMENTS

| | | | | |
|---|---|---|---|---|
| 2002/0070220 | A1* | 6/2002 | Kuehn | B65D 43/20 220/350 |
| 2008/0047962 | A1 | 2/2008 | Muriel Salvador | |
| 2012/0167774 | A1 | 7/2012 | Mordini et al. | |
| 2013/0270274 | A1* | 10/2013 | Pizzella | B65F 1/10 220/350 |

* cited by examiner

ARTICULATING LID FOR BEVERAGE CONTAINER

BACKGROUND

Beverage containers for receiving beverage from a brewer or other source of beverage and for thereafter serving the beverage are known in the art. Such beverage containers typically include a vessel for receiving the beverage, a top opening for receiving the beverage from the source and into the vessel, and a lid to enclose or cover the opening to prevent unwanted items for entering the vessel and/or to prevent beverage in the vessel from unintentionally spilling out of the vessel.

SUMMARY

The present disclosure relates to one or more of the following features, elements, or combinations thereof:

A beverage container is configured to retain a beverage from a brewer or other source of beverage, the beverage container including a vessel for retaining the beverage and a lid to close an opening into the vessel. The lid includes a base and a slideable and pivotable door that engages with the base to alternatively block or unblock the opening into the vessel of the beverage container through which the beverage may pass from the source of the beverage into the vessel of the container. The door may be a slideable from a first closed position that blocks the opening to a second opened position that permits access to the opening.

In illustrative embodiments, the door of the lid of the container includes a first panel and a second panel, where the second panel is permitted to articulate with respect to the first panel about a pivot axis. The first panel may be coupled to the base to permit the door to slide with respect to the base from the first position to the second position. As the door slides from the first position, the second panel may begin to slide out of interaction with the base. A gravitational pull on the second panel will cause the second panel to articulate with respect to the first panel about the pivot axis.

In illustrative embodiments, the first panel and second panel are locked together to prevent the first panel from disconnecting from the second panel until the second panel is rotated to a specific angle with respect to the first panel. In a particular embodiment, the first panel includes a pivot post and the second panel includes a pivot housing, the pivot housing surrounding the pivot post. A retention nub prevents disengagement of the pivot post from the pivot housing unless the second panel is pivoted to be substantially perpendicular to the first panel.

In illustrative embodiments, the door and base are configured to prevent misalignment of the door on the base. In a particular embodiment, first and second side panels of the door may be coupled to first and second tracks, respectfully, of a track system of the base that permits the door to slide with respect to the base. The track system may include offset features that prevent the first side panel of the door from engaging with the second track of the track system, or prevent the second side panel of the door from engaging with the first track of the track system, or both.

The present disclosure also may relate to one or more of the features, elements or combinations thereof described in the accompanying drawings described below or the Detailed Description set forth below.

Additional features will become apparent to those skilled in the art upon consideration of the following description exemplifying a proposed embodiment as presently perceived.

BRIEF DESCRIPTION OF DRAWINGS

The detailed description particularly refers to the accompanying figures in which.

DETAILED DESCRIPTION

Figure 1:
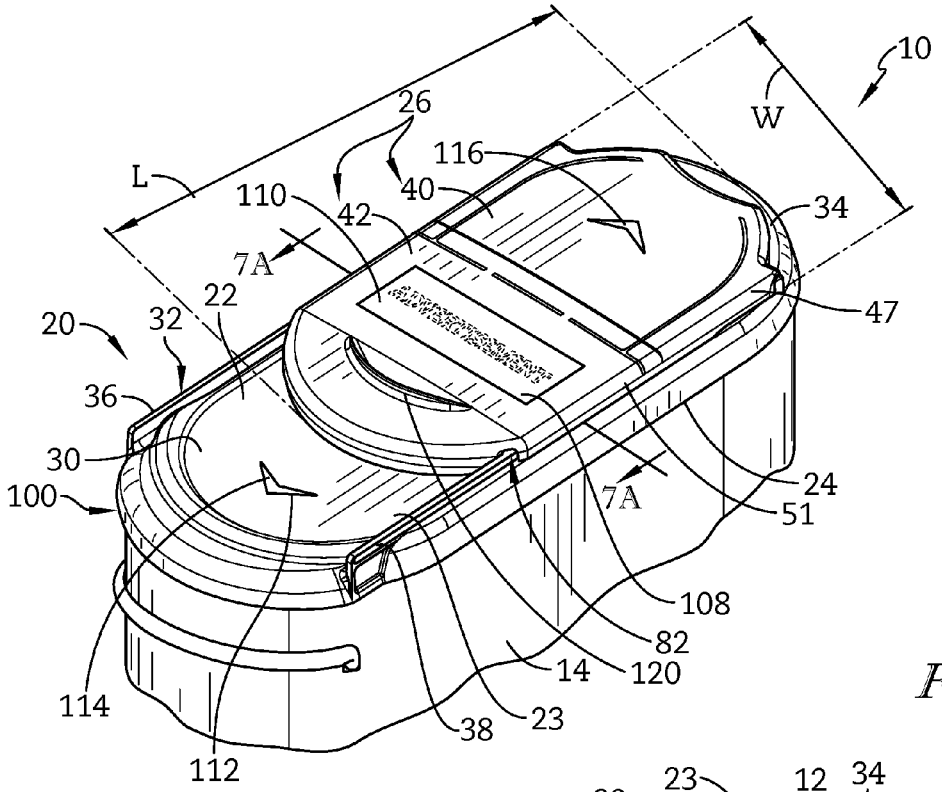
FIG. 1 is a partial perspective view of beverage container of the present disclosure, the beverage container including a vessel and a lid with a door in a first, closed position to block an opening into an interior of the vessel.

While the present disclosure may be susceptible to embodiment in different forms, there is shown in the drawings, and herein will be described in detail, at least one with the understanding that the present description is to be considered an exemplification of the principles of the disclosure and is not intended to limit the disclosure to the details of construction and the arrangements of components set forth in the following description or illustrated in the drawings.

Figure 2:
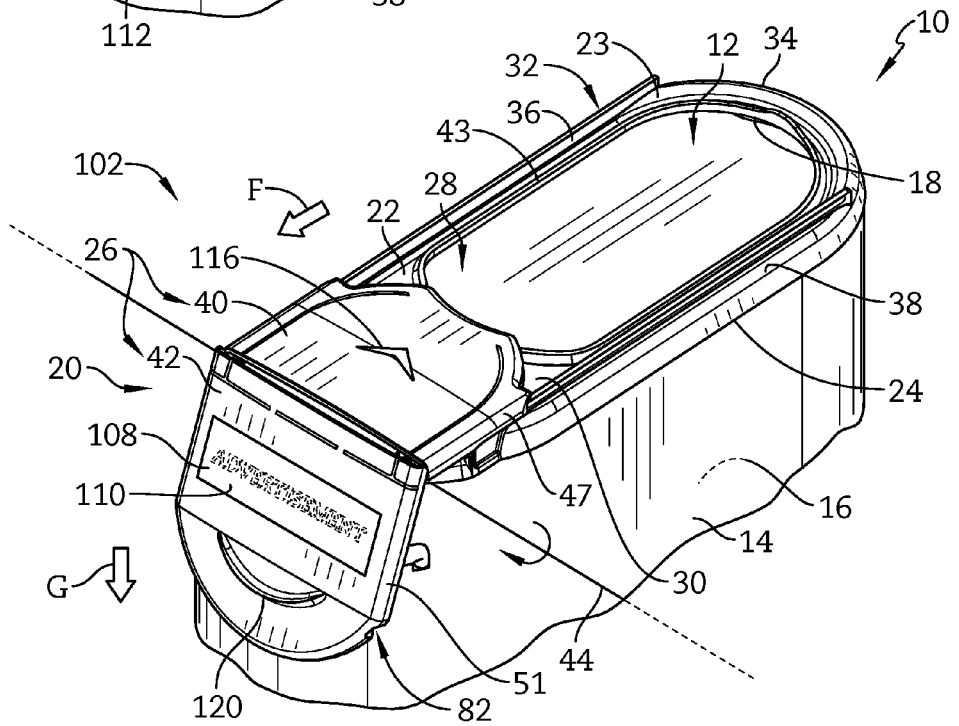
FIG. 2 is a partial perspective view of the beverage container of FIG. 1, showing the door of the lid has been slid away from the opening, and further showing a second panel of the door has pivoted with respect to a first panel of the door so that the second panel is angled downward toward a base of the beverage container, the door being in a second, opened position to permit access to the interior of the vessel through the opening.
Figure 9:
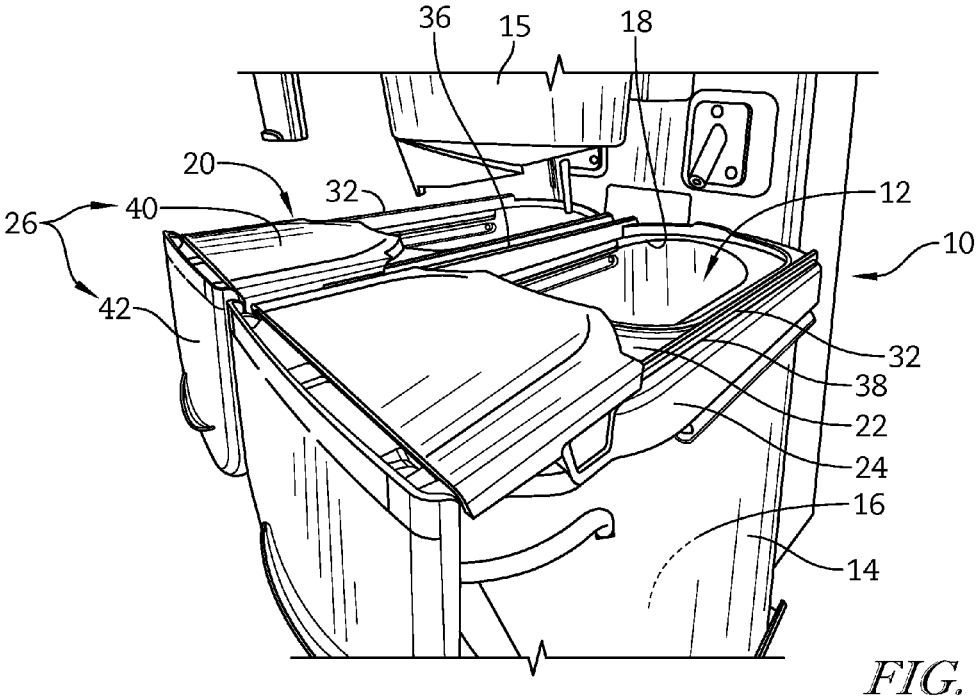
FIG. 9 is a top perspective view of the beverage container of FIG. 2 adjacent a beverage preparation apparatus.

FIGS. 1, 2 and 9 of the present disclosure provide an illustrative embodiment of a lid 20 of a beverage container 10 for holding a beverage 16 from a brewer or other source of beverage 15. The lid 20 is configured to be secured over an opening 12 formed in the container 10 that permits passage into a vessel 14 of the container to retain the beverage or other liquid 16. In illustrative embodiments, the opening 12 may be defined by a rim 18 of the vessel 14, and the lid 20 may be coupled to the rim 18 by any known means in the industry. One example of such means for coupling includes a snap-fitting or snap-locking arrangement, while still other arrangements are further known as well.

Figure 3:
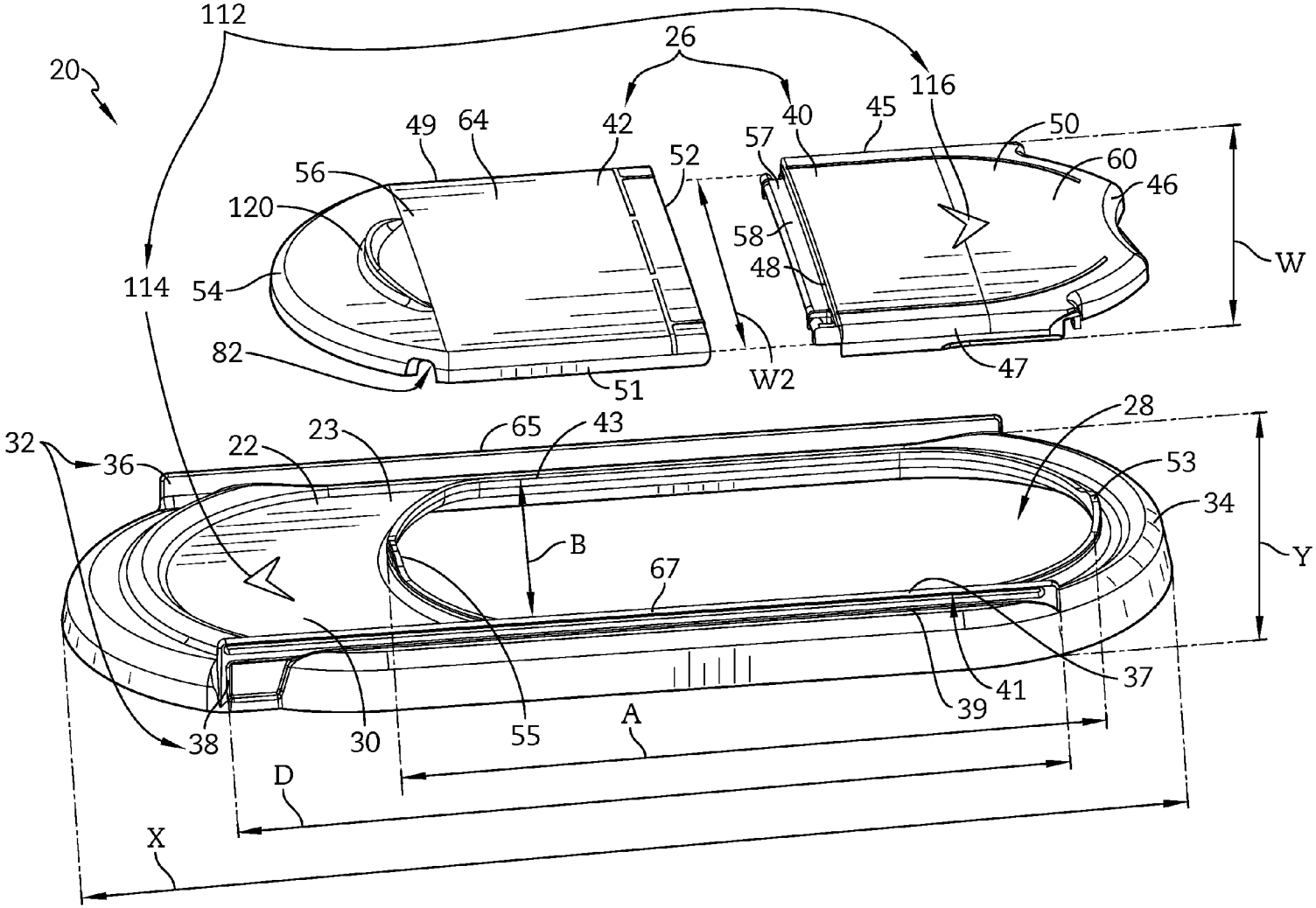
FIG. 3 is an exploded perspective view of the lid of FIG. 1.

As illustrated in FIG. 3, the lid 20 of the beverage container 10 generally includes a base 22, a mounting means 24 to couple the lid 20 to the vessel 14, and a door 26 slideably engaged with the base 22 to open or close the lid 20 when it is positioned on vessel 14. As illustrated in FIGS. 1 and 2, lid 20 is configured to extend over the opening 12 in order to selectively block or permit access to the vessel 14 through the opening 12 when the lid 20 is mounted to the vessel 14 by the mounting means 24. Specifically, FIG. 1 illustrates the lid 20 in a first closed position 100 whereby the base 22 and door 26 of the lid 20 cover the opening 12 to prevent access to the vessel 14 through the opening 12. Conversely, FIG. 2 illustrates the lid 20 in a second opened position 102 whereby the door 26 has slid to a different position along the base 22 to permit access to the vessel 14 through the opening 12. A sliding force F is applied to the door 26 to move the lid 20 from the first closed position 100 to the second opened position 102.

Figure 7A:
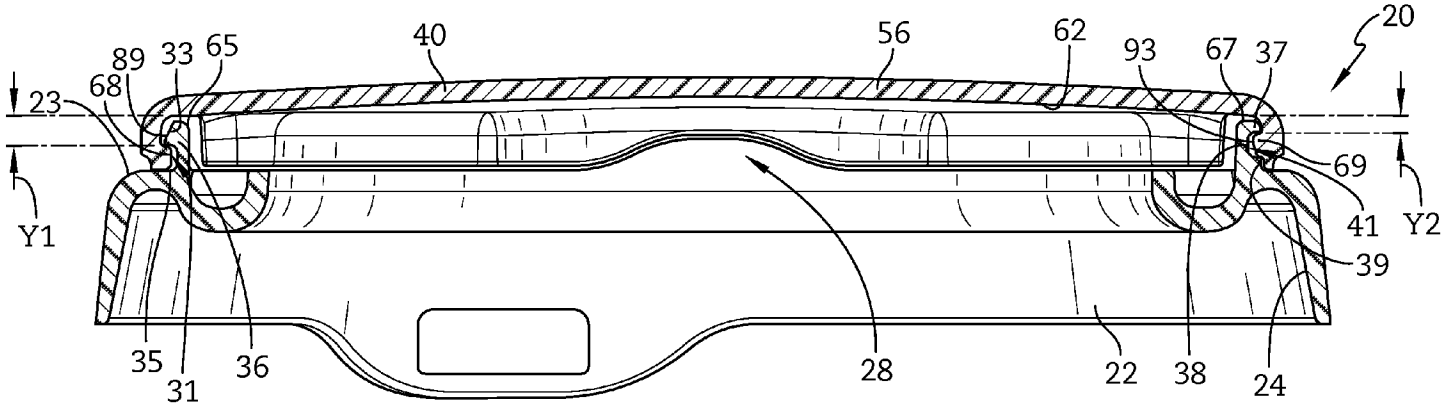
FIG. 7A is a cross section view taken along lines 7A-7A of FIG. 1.

In illustrative embodiments, the base 22 is shaped substantially to align with the opening 12 of vessel 14 and has a length X and a width Y. The base 22 may include an outer perimeter 34, a cover plate 30 that extends between the outer perimeter 34, and a track system 32 that extends adjacent a portion of the outer perimeter 34. As illustrated in FIGS. 3 and 7A, the outer perimeter 34 of the base 22 is joined to the mounting means 24 to mount the lid 20 onto the vessel 14. The track system 32 includes a first track 36 and a second track 38 that are substantially parallel to each other and extend along a substantial portion of the length X of base 22.

In illustrative embodiments, the cover plate 30 is formed to include an aperture 28. When lid 20 is placed on the vessel 14, the aperture 28 is configured to align with the opening 12 into the vessel 14 to permit a beverage or other liquid to flow through aperture 28 into the vessel 14, as illustrated in FIG. 2. The aperture 28 may extend between the first and second tracks 36 and 38 of the track system 32, as illustrated in FIG. 3, and has a length A and a width B.

Figure 4:
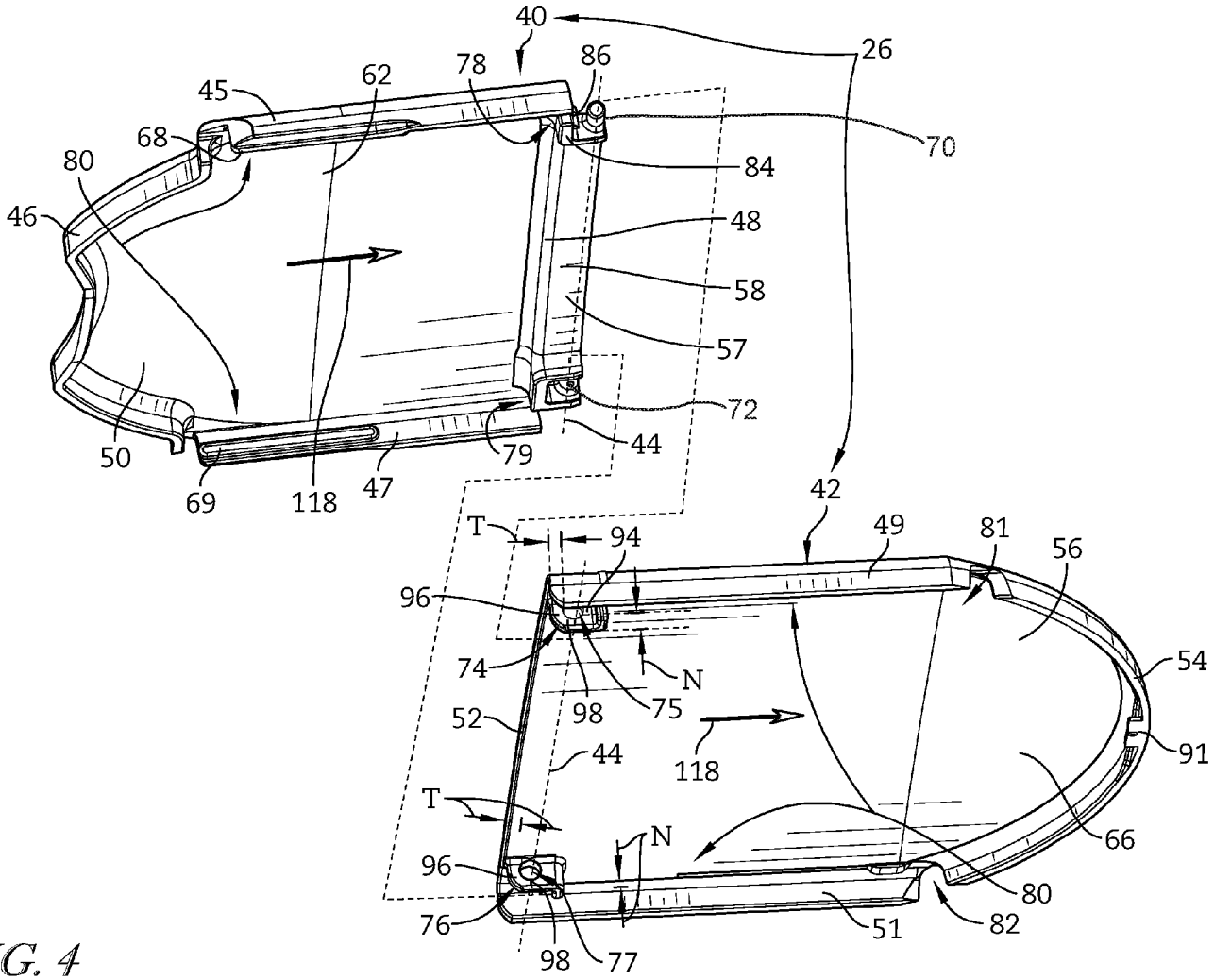
FIG. 4 is an exploded bottom perspective view of the door of the lid of FIG. 1.

In illustrative embodiments, the door 26 generally has a length L and a width W. As illustrated in FIGS. 3 and 4, the length L of the door 26 of lid 20 may be shaped to correspond to the aperture 28 formed in the base 22. For instance, the length L of the door 26 may substantially correspond to, or be slightly longer than, the length A of the aperture 28. The width W of the door is such as to permit it to at least extend from the first track 36 to the second track 38 of the track system 32, as illustrated in FIG. 7A. When the base 22 is mounted onto the vessel 14 via the mounting means 24, the door 26 is configured to completely cover the aperture 28 of the base 22 in the first closed position 100.

The door 26 is comprised of at least a first panel 40 and a second panel 42, the second panel 42 being pivotably connected to the first panel 40 to articulate about a pivot axis 44 on door 26. When the door 26 is positioned on the base 22 and the first and second panels 40 and 42 are coupled together, the first and second panels 40 and 42 are configured to move together in uniform movement from the first closed position 100 to the second opened position 102.

As illustrated in FIGS. 3-4, the first panel 40 includes a leading end 46, a connecting end 48 spaced apart from the leading end 46, a first side flange 45 extending between the leading end 46 and the connecting end 48, and a second side flange 47 spaced apart from the first side flange 45 and extending between the leading end 46 and the connecting end 48. A panel body 50 extends between the leading end 46, the connecting end 48, the first side flange 45 and the second side flange 47. The panel body 50 includes a top surface 60 and a bottom surface 62. The first and second side flanges 45, 47 extend down and away from the bottom surface 62.

The second panel 42 includes a connecting end 52, a trailing end 54 spaced apart from the connecting end 52, a first side flange 49 extending between the trailing end 54 and the connecting end 52, and a second side flange 51 spaced apart from the first side flange 49 and extending between the trailing end 54 and the connecting end 52. A panel body 56 extends between the connecting end 52, the trailing end 54, the first side flange 49 and the second side flange 51. The panel body 56 includes a top surface 64 and a bottom surface 66. The first and second side flanges 59 and 61 extend down and away from the bottom surface 66.

In illustrative embodiments, an outwardly extending connection ledge 58 is connected to and extends away from the connecting end 48 of the first panel 40. The connection ledge 58 may be connected to the connecting end 48 so that all portions of the connection ledge 58 are below the top surface 60 of first panel 40. As illustrated in FIG. 4, the connection ledge 58 extends down and away from a bottom surface 62 of first panel 40.

In illustrative embodiments, the connection ledge 58 includes a ledge body 57 that extends a width W2 that is less than the width W of the door 26. The width W2 is also less than the distance between the first and second side flanges 45 and 47 of the first panel 40 so that the ledge body 57 fits between the first and second side flanges 45 and 47. The connection ledge 57 includes a first pivot post 70 and a second pivot post 72 that extend annularly outward of connection ledge 57 towards first and second side flanges 45 and 47, and are substantially perpendicular to the width W of the door 26, as illustrated in FIG. 4. The first and second pivot posts 70 and 72 are configured to align with the pivot axis 44 when the first and second panels 40 and 42 are coupled together to form the door 26.

In illustrative embodiments, the bottom surface 66 of the second panel 42 includes a first pivot hub 74 and a second pivot hub 76, as illustrated in FIG. 4. The first and second pivot hubs 74 and 76 are positioned on the bottom surface 66 adjacent the connecting end 52 of the second panel 42, and are substantially parallel to the first and second side flanges 49 and 51. The first and second pivot hubs 74 and 76 are positioned to be spaced apart from each other a distance that is less than width W and are thereby positioned annularly inward of the first and second side flanges 49 and 51. The first and second pivot hubs 74 and 76 include a pivot aperture 75 and 77, respectively. The pivot apertures 75 and 77 are configured to align with the pivot axis 44 when the first and second panels 40 and 42 are coupled together to form the door 26.

In illustrative embodiments, the first and second pivot posts 70 and 72 are configured to engage with the first pivot hub 74 and the second pivot hub 76, respectively, that are attached to the bottom surface 66 of the second panel 42. Specifically, as illustrated in FIG. 4, the first panel 40 and second panel 42 are connected together by inserting the first pivot post 70 into the pivot aperture 75 of the first pivot hub 74 and inserting the second pivot post 72 into the pivot aperture 77 of the second pivot hub 76. The first pivot post 70 can thereby rotate within the first pivot hub 74, and the second pivot post 72 can rotate within the second pivot hub 76, with each pivot post 70 and 72 rotating about pivot axis 44.

Figure 8:
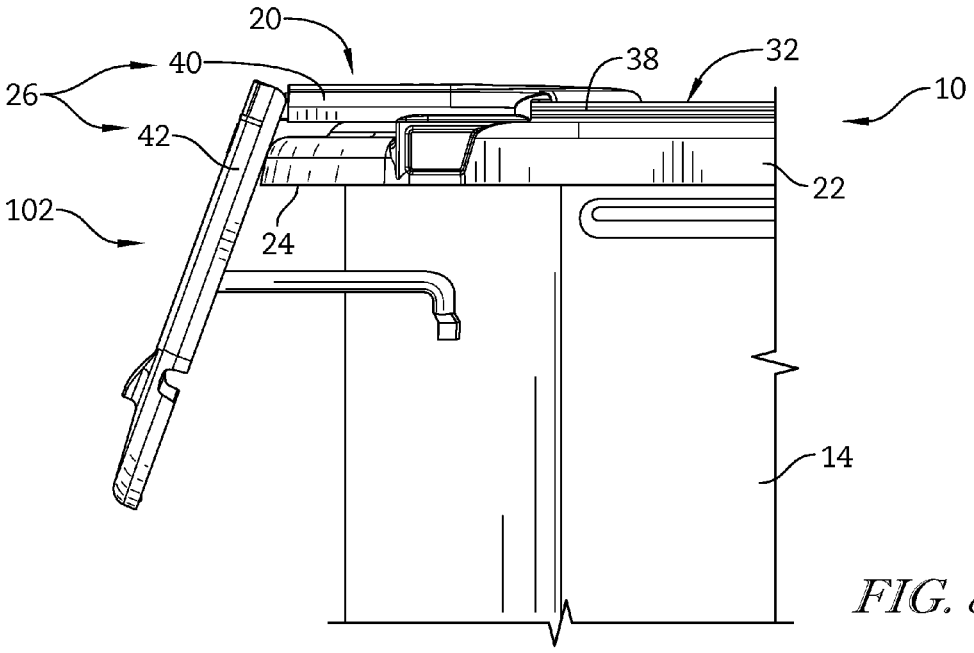
FIG. 8 is a side perspective view of the beverage container of FIG. 2.

As illustrated in FIGS. 2, 8 and 9, the rotation of the pivot posts 70 and 72 within the pivot hubs 74 and 76 permits the second panel 42 to rotate downward with respect to the first panel 40 when the second panel 42 is slid along the base 22 from the sliding force F to a point where the base 22 no longer contacts the second panel 42. Accordingly, the gravitation force G acting on the second panel 42 causes the second panel 42 to articulate with respect to the first panel 40 while the first panel 40 is still engaged with the base 22.

It should be noted that the top surface 60 of the first panel 40 provides interference to the top surface 64 of the second panel 42. Accordingly, if an upward force (not shown) is applied to the second panel 42 with respect to the first panel 40, the interference between the top surface 64 and the top surface 60 thereby blocks upward rotation of the second panel 42 with respect to the first panel 40.

The track system 32 of the base 22 is configured to permit the door 26 to slide from the closed position 100 to the opened position 102, as illustrated in FIGS. 1 and 2. In illustrative embodiments, the first and second tracks 36 and 38 of the track system 32 extend upwardly from a top surface 23 of the cover plate 30 of the base 22, as illustrated in FIG. 3. The first track 36 comprises a top rail 33, a bottom rail 35, and a groove 31 extending between the top rail 33 and the bottom rail 35. Similarly, the second track 38 comprises a top rail 37, a bottom rail 39, and a groove 41 extending between the top rail 37 and the bottom rail 39. In illustrative embodiments, the top rails 33, 37 and the bottom rails 35, 39 extend annularly outward from the base 22 in an opposing manner. In illustrative embodiments, the grooves 31 and 41 extend a distance D along the first and second tracks 36 and 38. The first and second tracks 36 and 38 include top surfaces 65 and 67, respectively, that define the upper boundary of the first and second tracks 36 and 38.

In illustrative embodiments, the door 26 is connected to the track system 32 of the base 22 along the first and second side flanges 45 and 47 of the first panel 40 of the door 26. Specifically, as illustrated in FIG. 4, first and second side flanges 45 and 47 of the first panel 40 each include a locking protrusion 68 and 69, respectively. The locking protrusions 68 and 69 are configured to extend below the bottom surface 62 of the first panel 40 and are configured to face annularly inward toward the panel body 50 of the first panel 40. The locking protrusions 68 and 69 are configured to be received in snap-fit engagement with the grooves 31 and 41 of the first and second tracks 36 and 38, as illustrated in FIG. 7A. Accordingly, the top and bottom rails 33, 35, 37, and 39 cause the locking protrusions 68 and 69 to be retained in the grooves 31 and 41. The locking protrusions 68 and 69 are thereafter able to slide or glide along the distance D of the grooves 31 and 41 of the first and second tracks 36 and 38.

Figure 5A:
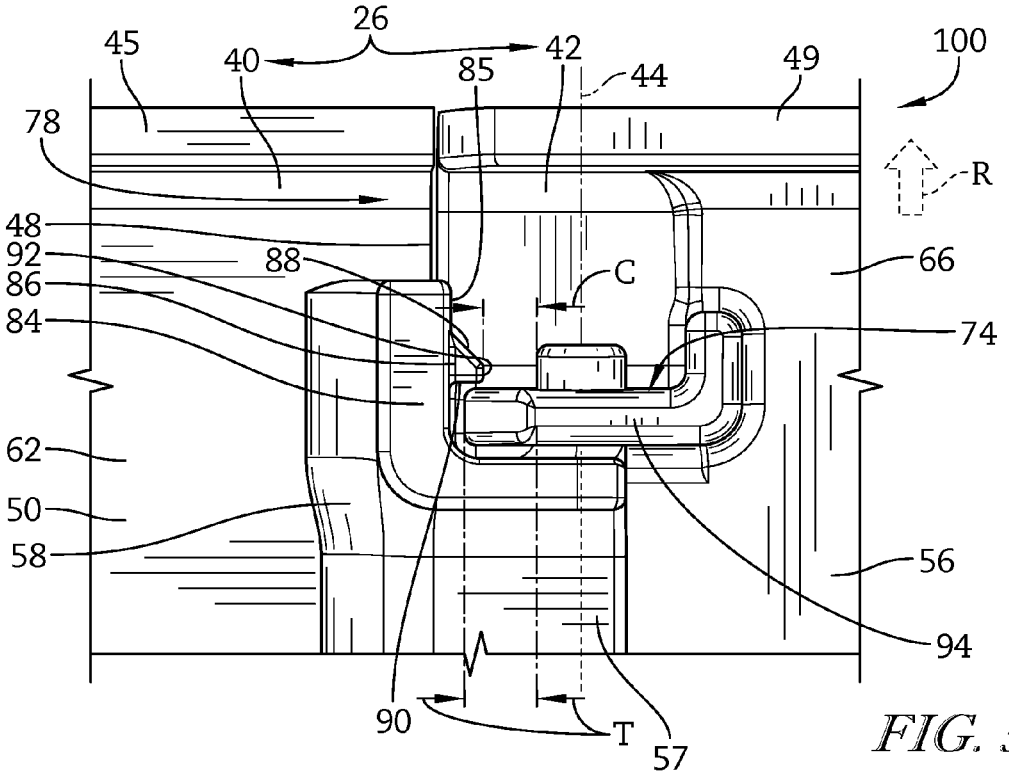
FIG. 5A is a partial, detailed view showing engagement of the first and second panels of the door of FIG. 4, wherein the second door is substantially in linear arrangement to the first door as shown in the first, closed position of FIG. 1.
Figure 5B:
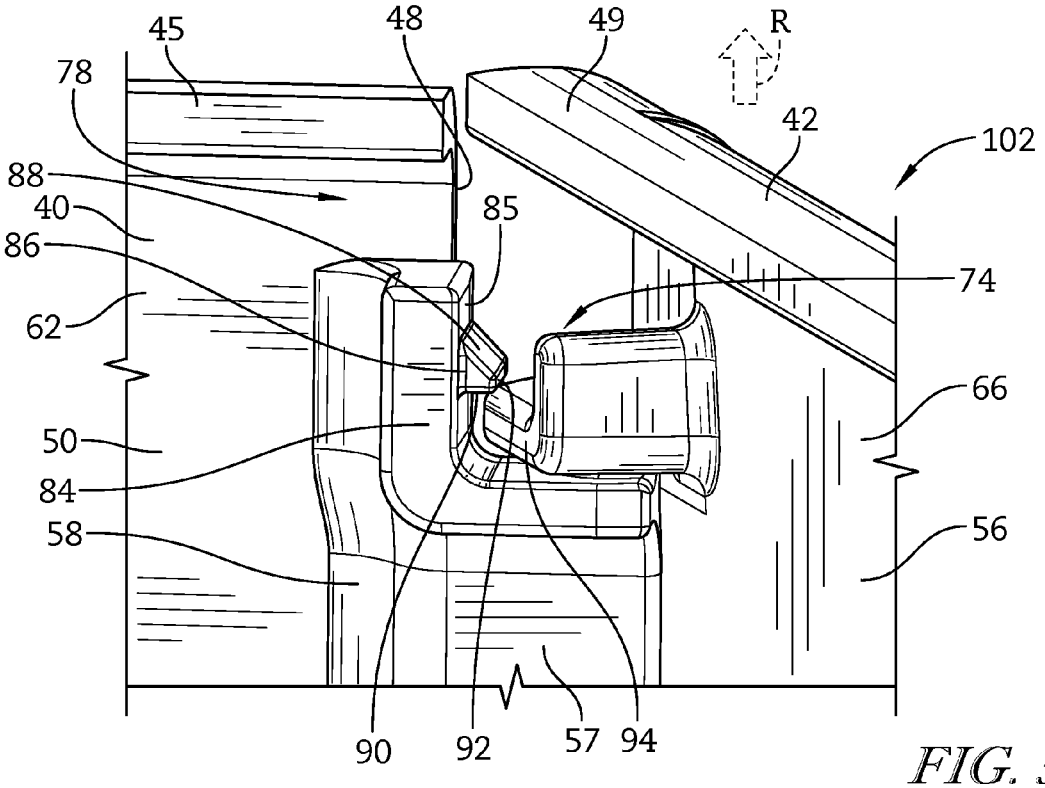
FIG. 5B is a partial, detailed view similar to FIG. 5A, showing the second door has articulated or pivoted with respect to the first door as substantially shown in the second, opened position of FIG. 2.

As illustrated in FIG. 4, the first and second panels 40 and 42 of the door 26 may be configured to extend over and around the track system 32 of the base 22. For example, the first and second side flanges 45, 47, 49 and 51 of the first and second panels 40 and 42 may be positioned radially outside of the track system 32 when the door 26 is positioned on the base 22, and a track spacing 80 may be formed in the door 26 in order to permit the tracks 36 and 38 to slide therein. In illustrative embodiments, the connection ledge 58 coupled to the connecting end 48 of the first panel 40 and the first and second pivot hubs 74 and 76 coupled to the bottom surface 66 of the second panel 42 are positioned to be radially inward of the track spacing 80, as illustrated in FIGS. 5A-5B.

In illustrative embodiments, the cover plate 30 of base 22 include an opening rim 43 formed around the aperture 28, as illustrated in FIG. 3. The opening rim 43 may include a first engagement lip 53 and a second engagement lip 55. The first engagement lip 53 may be positioned to extend above the opening rim 43 and be positioned adjacent the outer perimeter 34 of the base 22. The second engagement lip 55 may similarly be positioned to extend above the opening rim 43 and is positioned on the opposite side of the aperture 28. When the door 26 is slid along the track system 32 from the second opened position 102 to the first closed position 100, the leading end 46 of the first panel 40 abuts against the upwardly extending first engagement lip 53, preventing further movement of the door 26 past the first closed position 100. Similarly, when the door 26 is slid along the track system 32 from the first closed position 100 to the second opened position 102, the leading end 46 of the first panel 40 abuts against the upwardly extending second engagement lip 55, preventing further movement of the door past the second opened position 102.

Similarly, in illustrative embodiments, a retention lip 91 may be positioned on the trailing end 54 of the second panel 42, as illustrated in FIG. 43. The retention lip 91 may be positioned to engage with the second engagement lip 55 of the opening rim 43 to prevent or block movement of the door 26 past the first closed position 100. Other means for preventing unintended movement of the door 26 past the first and second positions 100 and 102 are envisioned herein.

The track spacing 80 may comprise an opening 78 that extends between the first side flange 45 and the connecting end 48 and an opening 79 that extends between the connecting end 48 and the second side flange 47 of the first panel 40. The openings 78 and 79 may permit the first and second tracks 36 and 38 to extend through the connecting end 48 of the first panel 40 when the door 26 is coupled to the track system 32 of the base 22. Similarly, the track spacing 80 may comprise an opening 81 that extends between the first side flange 49 and the trailing end 54, and an opening 82 that extends between the trailing end 54 and the second side flange 51 of the second panel 42. As illustrated in FIG. 1, the openings 81 and 82 may permit the first and second tracks 36 and 38 to extend through the trailing end 54 of the second panel 42 when the door 26 is coupled to the track system 32 of the base 22. The track spacing 80 and openings 78, 79, 81 and 82 permit the door 26 to slide over the track system 32 of the base 32 while still maintaining the connection between the door 26 and the track system 32.

In an illustrative embodiment, the track system 32 and locking protrusions 68 and 69 may be configured to prevent improper placement of the door 26 on the base 22. Specifically, the track system 32 may be designed to permit placement of the door 26 on the base 22 in only one manner. The engagement of the door 26 and the track system 32 may be designed such that if the door 26 is placed on the base 22 in an unintended manner, the door 26 cannot be properly coupled to the track system 32, thereby preventing the door 26 from sliding properly along the track system 32.

Figure 6A:
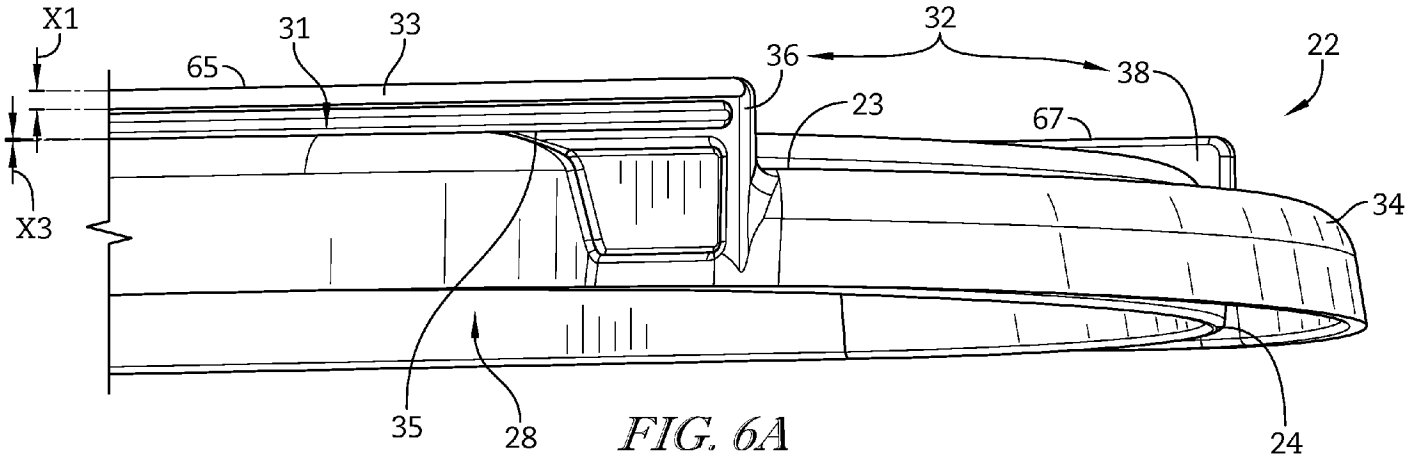
FIG. 6A is a partial, side view of a base of the lid of FIG. 1.
Figure 6B:
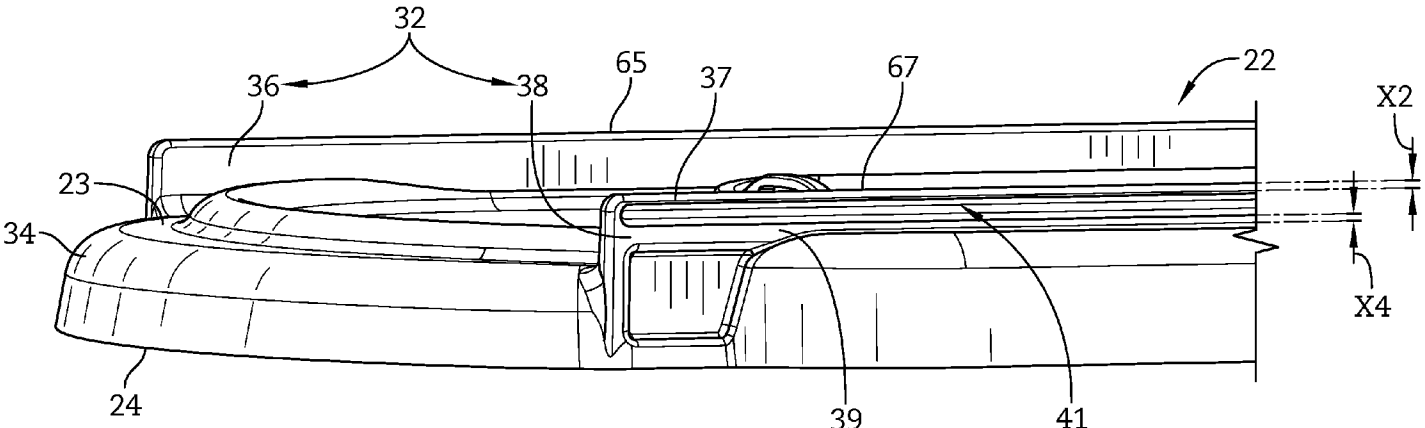
FIG. 6B is a partial, side view similar to FIG. 6A, showing an opposite side of the base of the lid.

FIG. 7A presents a cross-sectional view of the door 26 and the track system 32 in proper engagement with each other. As illustrated in FIGS. 6A and 6B, the top rail 33 of the first track 36 of the track system 32 may have a width X1, and the top rail 37 of the second track 38 of the track system may have a width X2. The bottom rail 35 of the first track 36 may have a width X3, and the bottom rail 39 of the second track 38 may have a width X4. The width X1 may be larger than the width X2 such that the grooves 31 and 41 of the track system 32 are not positioned the same distance from the top surfaces 65 and 67 of the first and second tracks 36 and 38. This may cause the width X3 to be less than the width X4, as illustrated in FIGS. 6A and 6B.

Conversely, and as illustrated in FIG. 7A, the locking protrusions 68 and 69 may be positioned a distance Y1 and Y2, respectively, away from the bottom surface 62 of the first panel 40. The width X1 of the top rail 33 of the first track 36 may be determined to be equal to or less than the distance Y1 such that the top rail 33 fits within the space Y1 between the locking protrusion 68 and the bottom surface 62 of the first panel 40. Similarly, the width X2 of the top rail 37 of the second track 38 may be determined to be equal or less than the distance Y2 such that the top rail 37 fits within the space Y2 between the locking protrusion 68 and the bottom surface 62 of the first panel 40.

Figure 7B:
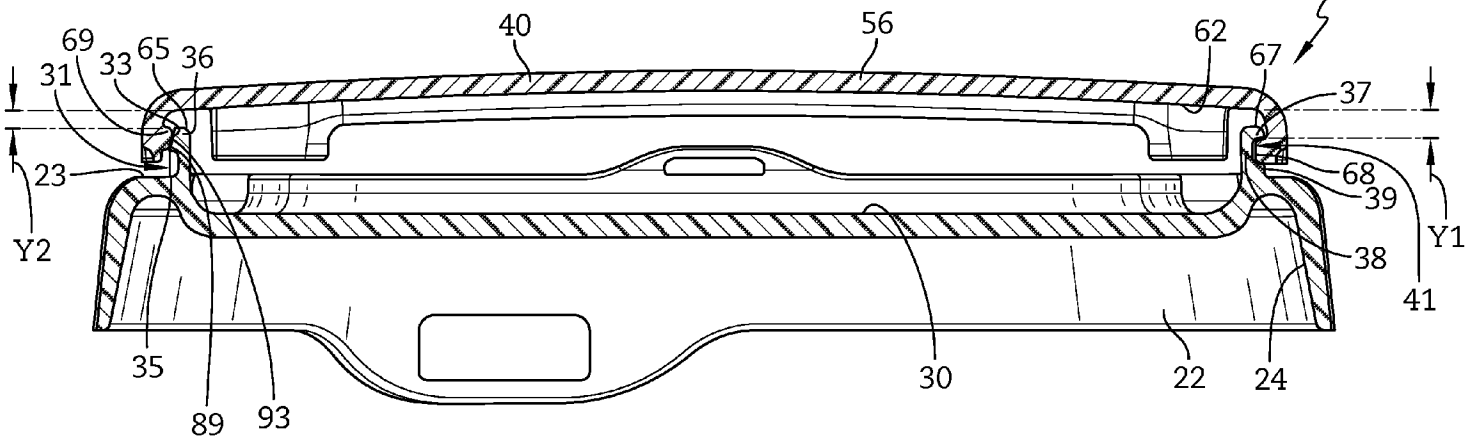
FIG. 7B is a cross-sectional view similar to FIG. 7A but shows the interaction of the door with the base when the door is improperly coupled to the base of the lid.

FIG. 7B presents a cross-sectional view of the door 26 and the track system 32 in improper engagement with each other. Should the door 26 be positioned such that the locking protrusion 68 is adjacent to the second track 38 instead of the first track 36, and the locking protrusion 69 is adjacent to the first track 36 instead of the second track 38, the variation in distances X1, X2 and Y1, Y2 will prevent the door 26 from being coupled to the track system 32.

For instance, and as illustrated in FIG. 7B, when the locking protrusion 68 is positioned in the groove 41 of the second track 38, the distance Y1 between the locking protrusion 68 and the bottom surface 62 of the first panel 40 is substantially greater than the width X2 of the top rail 37 of the second track 38. This variation in distance between Y1 and X2 will cause the door 26 to be raised higher than it would be if the door 26 was properly positioned on the track system 32. Conversely, and as illustrated in FIG. 7B, when the locking protrusion 69 is positioned adjacent the groove 31 of the first track 36, the distance Y2 between the locking protrusion 69 and the bottom surface 62 of the first panel 40 is smaller than the width X1 of the top rail 33 of the first track 36. This variation in distance between Y2 and X1 will prevent the locking protrusion 69 from engaging with the groove 31. In illustrative embodiments, this misalignment may be enhanced because the top surface 65 of the first track 36 will abut against the bottom surface 62 of the first panel 40, or because the door 26 is raised higher due to the variation in distances between Y1 and X2 on the second track 38, or both.

In illustrative embodiments, the misalignment of the locking protrusion 69 with the first track 36 may be enhanced by use two chamfered surfaces. Specifically, an exterior surface 89 of the top rail 33 of the first track 36 may be chamfered, as illustrated in FIG. 7A. Similarly, an interior surface 93 of the locking protrusion 69 may be conversely chamfered. When the locking protrusion 69 engages improperly aligns with the first track 36, the chamfered surfaces 89 of the top rail 33 frictionally engages with the chamfered surface 93 of the locking protrusion 69, thereby preventing the locking protrusion 69 from moving down into the groove 31.

The misalignment feature of the present disclosure is not limited to the specific structure disclosed herein. It is within the scope of the invention to implement other features to prevent the misalignment of the door 26 to the track system 32.

Figure 5C:
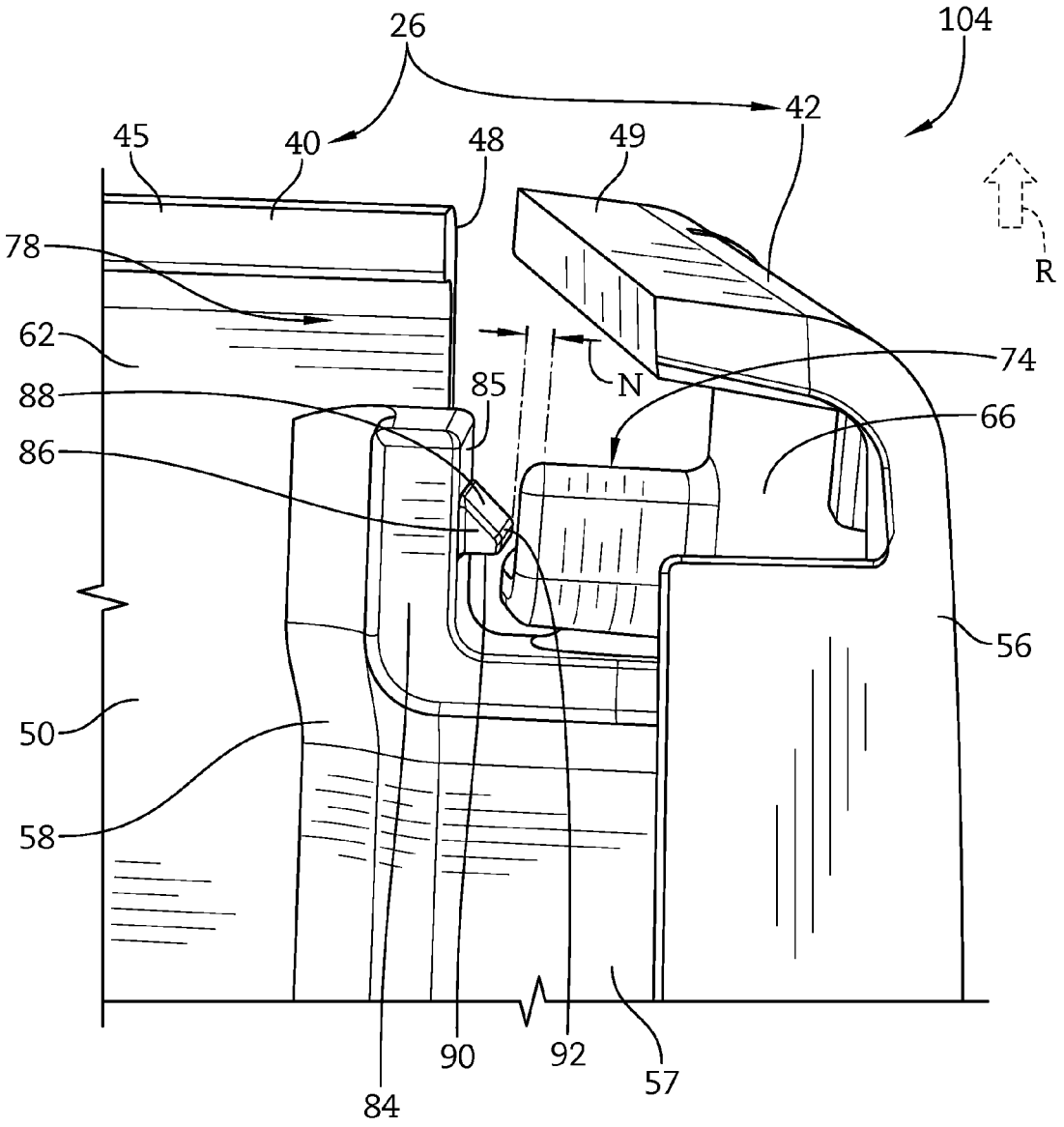
FIG. 5C is a partial, detailed view similar to FIG. 5B, showing the second door has articulated or pivoted to be substantially perpendicular to the first door in a third, removed position that the doors may be moved to when the lid of FIG. 2 has been removed from the vessel of the beverage container.

In another alternative embodiment, the door 26 is configured to prevent unintentional uncoupling of the first panel 40 and the second panel 42. As mentioned, the door 26 can be positioned in the first closed position 100 as shown in FIG. 1, the second opened positioned 102 as shown in FIG. 2, or a third separated position 104 where the door 26 is removed from the track system 32 of the base 22 as envisioned in FIG. 3. FIGS. 5A-5C illustrate how the first panel 40 and second panel 42 are generally coupled together in the first position 100, second position 102, and third position 104, respectively, and as explained more fully below, illustrate how the first panel 40 and the second panel 42 are prevented from unintentional decoupling in these positions.

FIG. 5A illustrates a detailed view of the connection between the first panel 40 and the second panel 42, showing a portion of the connection ledge 58, including the connection flange 57 and the first pivot hub 74. As illustrated in FIG. 5A, the first pivot post 70 coupled to the first panel 40 is inserted into and surrounded by the first pivot hub 74 coupled to the second panel 42. A similar coupling occurs between the second pivot post 72 and the second pivot hub 76 (not shown). The first pivot post 70 extends from a collared portion 84 forming one end of the connection flange 57. The collared portion 84 including a retention nub 86 that extends toward the first pivot post 70 from a side surface 85 of the collared portion 84. The retention nub 86 includes a ramped surface 88, a blocking surface 90, and a top surface 92, as illustrated in FIG. 5A. The clearance distance between the top surface 92 and the first pivot post 70 is C, as illustrated in FIG. 5A.

The first pivot hub 74 includes a collar 94 that substantially surrounds the pivot aperture 75 extending through the first pivot hub 74, as shown in FIGS. 4-5C. The collar 94 includes a wider portion 96, where the distance from the pivot aperture 75 to the edge of the collar 94 is approximately T, and a narrower portion 98, where the distance from the pivot aperture 75 to the edge of the collar 94 is approximately N. In illustrative embodiments, the distance T is greater than the distance C, while the distance N is less than the clearance distance C between the top surface 92 of the retention nub 86 and the first pivot post 70.

In illustrative embodiments, when the lid is in the first closed position 100, the first panel 40 and the second panel 42 are positioned to be substantially in line with each other. In this position, when the first pivot hub 74 is around the first pivot post 70, the retention nub 86 prevents the first pivot hub 74 from disengaging with the first pivot post 70. Specifically, the wider portion 96 of the collar 94 of the first pivot hub 74 abuts against the blocking surface 90 of the retention nub 86, as illustrated in FIG. 5A. If a remove force R is applied to the second panel 42, the wider portion 96 of the collar 94 is prevented from moving past the retention nub 86 because the wider portion has an approximate width T that is greater than the distance C between the top surface 92 of the retention nub 86 and the first pivot post 70. Accordingly, the first panel 40 and the second panel 42 are substantially locked together when the lid 20 is in the first closed position 100.

As the lid is moved to the second opened position 102, the second panel 42 is rotated with respect to the first panel 40 above the pivot axis 44, as discussed above. In illustrative embodiments, and as shown in FIGS. 2 and 8, the second panel 42 rotates to an angle that is below 180 degrees but above 90 degrees with respect to the first panel 40 in the second opened position 102. The second panel 42 is maintained in a position that is greater than 90 degrees with respect to the first panel 40 by any number of means, for example, by abutment of the second panel 42 with the mounting means 24 or a portion of the vessel 14, as illustrated in FIG. 8. In this second opened position, if a remove force R is applied to the second panel 42, the collar 94 of the first pivot hub 74 is still prevented from being removed from engagement with the first pivot post 70 by the blocking surface 90 of the retention nub 86, as illustrated in FIG. 5B. Accordingly, the first panel 40 and the second panel 42 are still substantially locked together when the lid 20 is in the second opened position 102.

When the door 26 is removed from the track system 32 of the base 22 in the third position 104, the second panel 42 is free to rotate to be substantially 90 degrees with respect to the first panel 40. As illustrated in FIG. 5C, when the second panel 42 is rotated to be substantially 90 degrees with respect to the first panel 40, the collar 94 of the first pivot hub 74 is rotated with respect to the retention nub 86 such that the narrower portion 98 of the collar is adjacent the retention nub 86. Because the width N of the narrower portion 98 is less than the clearance distance C between the top surface 92 of the retention nub 86 and the first pivot post 70, a removal force R will cause the first pivot hub 74 to move past the retention nub 86 and disengage from the first pivot post 70. Accordingly, the first panel 40 and the second panel 42 may be disengaged from each other and separated. This separation may be beneficial for various purposes, including, for example, cleaning and maintenance of the lid 20.

In illustrative embodiments, a portion of the top surface 64 of the second panel 42 may include a media-receiving area 108, as illustrated in FIGS. 1 and 2. The media-receiving area may be positioned such that a sticker or other media 110 would be visible for someone standing in front of the container 10 when the door 26 is the second opened position 102 and the container 10 is positioned on a counter or similar location for use, as illustrated in FIG. 9. The media 110 may provide means for advertisement or beverage identification. Other purposes for the media 110 are well known in the industry.

In other illustrative embodiments, the base 22 and the door 26 of the lid 20 may further include visual indicators 112 to show assembly direction and slid direction for the door 26. As illustrated in FIGS. 1-3, the base 22 may include a n opening directional arrow 114 that illustrates the direction to move the door 26 when sliding the door 26 from the first closed position 100 to the second opened position 102. Conversely, the door 26 may include a closing directional arrow 116 to illustrates the direction to move the door 26 when sliding the door 26 from the second opened position 102 to the first closed position 100. As illustrated in FIG. 4, the bottom surfaces 62 and 66 of the first and second panels further include assembly arrows 118 that illustrate the direction of movement of the door 26 when the panels 40 and 42 are properly coupled to the track system 32 of the base 22.

In other illustrative embodiments, the door 26 may further include a finger grip 120. The finger grip 120 provides a touch point to held aid a user applying the opening force F to the door 26 when moving the lid 20 from the first closed position 100 to the second opened position 102 or vice versa. The finger grip 120 may also prevent a user from unintentionally contacting a portion of the aperture 28 when the lid 20 is the second opened position 102, thereby reducing the likelihood of unintentional contamination of the beverage from a user's hands In other illustrative embodiments, the lid 20 may include a locking mechanism (not shown) to secure the lid 20 to the vessel 14 in order to prevent tampering of the beverage by unintended persons. Various types of locking mechanisms are known in the art to prevent the lid 20 from being removed from the vessel 14 without hindering the articulating operation of the door 26 as described herein.

Terms including brewed, brewing, brewed liquid, beverage, and other liquid beverage as used herein are intended to be broadly defined as including but not limited to the brewing of coffee, tea or any other beverage desired to be dispensed from a container. This broad interpretation is also intended to include, but is not limited to any process of dispensing, infusing, steeping, reconstituting, diluting, dissolving, saturating or passing a liquid through or otherwise mixing or combining a beverage substance with a liquid such as water without a limitation to the temperature of such liquid unless specified.

The embodiment set forth in this description is not intended in any way to limit the scope of the present application and appended claims. The embodiment is intended to be expansive and broadly interpreted without limitation. Various features of the disclosed invention have been particularly shown and described in connection with the disclosure as shown and described, however, it must be understood that these particular arrangements and methods merely illustrate, and that the disclosure is to be given its fullest interpretation within the terms of the appended claims.

We claim:

1. A lid for a beverage container for retaining a volume of beverage, the lid comprising:

a base extending at least partially over an opening of the container, the base including a cover plate and a track system that extends above the cover plate, the cover plate formed to include an aperture that at least partially aligns with the opening of the container to provide access into a vessel of the container in which beverage is contained;

a door configured to slide along the track system of the base, the door permitted to slide with respect to the base from a first closed position, whereby the door blocks access to the vessel of the container through the aperture of the base, to a second opened position, whereby the door does not block access to the vessel of the container through the aperture of the base;

wherein the door includes a first panel and a second panel, the first panel being hingeably connected to the second panel to permit the second panel to articulate with respect to the first panel when the door is slid from the first closed position; and wherein the track system includes a first track and a second track spaced apart from the first track, and wherein the first track is shaped differently than the second track.

2. The lid of claim 1, wherein the first and second track each include a top rail, a bottom rail, and a groove positioned in between the top rail and bottom rail.

3. The lid of claim 2, wherein the top rail of the first track has a first width and the top rail of the second track has a second width, wherein the first width is greater than the second width.

4. The lid of claim 3, wherein at least the first panel of the door includes a first locking protrusion configured to engage with the groove of the first track and positioned a first distance from a bottom surface of the first panel, and a second locking protrusion configured to engage with the groove of the second track and positioned a second distance from a bottom surface of the first panel.

5. The lid of claim 4, wherein the second locking protrusion configured to engage with the groove of the second track cannot engage with the groove of the first track.

6. The lid of claim 4, wherein the width of the top rail of the first track is equal to or greater than the first distance between the first locking protrusion and the bottom surface of the first panel.

7. The lid of claim 4, wherein the top rail of the first track includes an exterior chamfered surface and the second locking protrusion includes an interior chamfered surface, the chamfered surfaces configured to engage frictionally with each other when the second locking protrusion is aligned with the first track.

8. A lid for a beverage container for retaining a volume of beverage, the lid comprising:

a base extending at least partially over an opening of the container, the base including a cover plate and a track system that extends above the cover plate, the cover plate formed to include an aperture that at least partially aligns with the opening of the container to provide access into a vessel of the container in which beverage is contained;

a door configured to slide along the track system of the base, the door permitted to slide with respect to the base from a first closed position, whereby the door blocks access to the vessel of the container through the aperture of the base, to a second opened position, whereby the door does not block access to the vessel of the container through the aperture of the base;

wherein the door includes a first panel and a second panel, the first panel being hingeably connected to the second panel to permit the second panel to articulate with respect to the first panel when the door is slid from the first closed position;

wherein the first panel and the second panel are coupled together with at least one pivot pin engaged with a pivot housing; and wherein a retention nub prevents the pivot pin from disengaging with the pivot housing unless the second panel is articulated to at least substantially 90 degrees to the first panel.

* * * * *